United States Patent [19]

Hendricks

[11] Patent Number: 5,062,381

[45] Date of Patent: Nov. 5, 1991

[54] GAME DATA BOARD

[76] Inventor: Kenneth J. Hendricks, 718 Coral Ave., Bartlett, Ill.

[21] Appl. No.: 575,375

[22] Filed: Aug. 29, 1990

[51] Int. Cl.[5] ..... A63B 71/06

[52] U.S. Cl. ..... 116/225; 116/222; 116/321; 116/323; 24/11 PP

[58] Field of Search ..... 116/222-225, 116/321, 323, 324; 24/11 PP, 67.3, 67.11; 273/DIG. 26; 235/1 B, 123

[56] References Cited

U.S. PATENT DOCUMENTS

| | | | |
|---|---|---|---|
| 546,959 | 9/1895 | Larzetere | 116/225 |
| 2,134,039 | 10/1938 | Gibbs | 116/223 |
| 2,731,941 | 1/1956 | Anderson | 116/324 |
| 3,204,356 | 9/1965 | Close et al. | 24/67.3 |
| 3,902,450 | 9/1975 | Bosshold | 116/323 |
| 4,157,152 | 6/1979 | Blastic | 224/247 |
| 4,610,054 | 9/1986 | Malian | 24/67 R |
| 4,738,449 | 4/1988 | Droz | 273/29 R |

*Primary Examiner*—William A. Cuchlinski, Jr.
*Assistant Examiner*—W. Morris Worth
*Attorney, Agent, or Firm*—Thomas R. Vigil

[57] ABSTRACT

A game data board formed as a planar subsrate having an upper surface and lower surface; a first marking slide; first passage means in the upper surface of the planar substrate for receiving the first marking slide and for permitting movement of the first marking slide therein; first indicia on the upper surface of the planar substrate adjacent the first passage means and arranged relative to the first marking slide so as to permit the first marking slide to be moved in the first passage means to various positions adjacent the first indicia for indicating particular scoring for at least one sport; a second marking slide; second passage means in the upper portion of the planar substrate for receiving the second marking slide and for permitting movement of the second marking slide therein; second indicia on the upper surface of the planar substrate adjacent the second passage means and arranged relative to the second marking slide so as to permit the second marking slide to be moved in the second passage means to various positions adjacent the second indicia for indicating particular scoring for at least one other sport or game; the first passage means including an upwardly facing bottom surface; and third indicia on the bottom surface of the first passage means for indicating scores or statistics for the at least one other sport or game.

24 Claims, 2 Drawing Sheets

GAME DATA BOARD

BACKGROUND OF THE INVENTION

1. Field of the Invention

The present invention relates to a GAME DATA BOARD comprising a planar substrate having marking slides in slots formed in the upper surface of the substrate and indicia in the form of letters, numbers and line marks adjacent the slots.

The marking slides are moveable to positions adjacent the indicia for temporarily indicating a score, a ball position or other element of a sport.

2. Description of the related art including information disclosed under 37 CFR sections 1.97–1.99

Heretofore clip boards have been used with scoring sheets or cards that are clipped to the board for keeping track of elements of the sport such as baseball, soccer, volleyball, basketball, ice hockey to name a few.

Also it has been proposed to provide such clipboards with a smooth polished surface on which one can mark information relative to a sport with a marker pen.

Coaching aids of the type described above are available from Korney Board Aids of Roxton, Tex.

As will be described in greater detail hereinafter, the GAME DATA BOARD of the present invention differs from the scoring/coaching aids described above by providing not only a planar substrate but also at least one marking slide mounted in a slot in the upper surface of the substrate and moveable to positions along the slot adjacent letter, number or line marks for temporarily indicating the present status of an element of a sport.

SUMMARY OF THE INVENTION

According to the present invention, there is provided a GAME DATA BOARD comprising: a planar substrate having an upper surface and lower surface; a first marking slide; first passage means in the upper surface of the planar substrate for receiving the first marking slide and for permitting movement of the first marking slide therein; first indicia on the upper surface of the planar substrate adjacent the first passage means and arranged relative to the first marking slide so as to permit the first marking slide to be moved in the first passage means to various positions adjacent the first indica for indicating particular scoring for at least one sport; a second marking slide; second passage means in the upper surface of the planar substrate for receiving the second marking slide and for permitting movement of the second marking slide therein; second indicia on the upper surface of the planar substrate adjacent the second passage means and arranged relative to the second marking slide so as to permit the second marking slide to be moved in the second passage means to various positions adjacent the second indicia for indicating particular scoring for at least one other sport or game; the first passage means including and upwardly facing bottom surface; and third indicia on the bottom surface o the first passage means for indicating scores or statistics for the at least one other sport or game.

DESCRIPTION OF THE PREFERRED EMBODIMENT(S)

Figure 1:
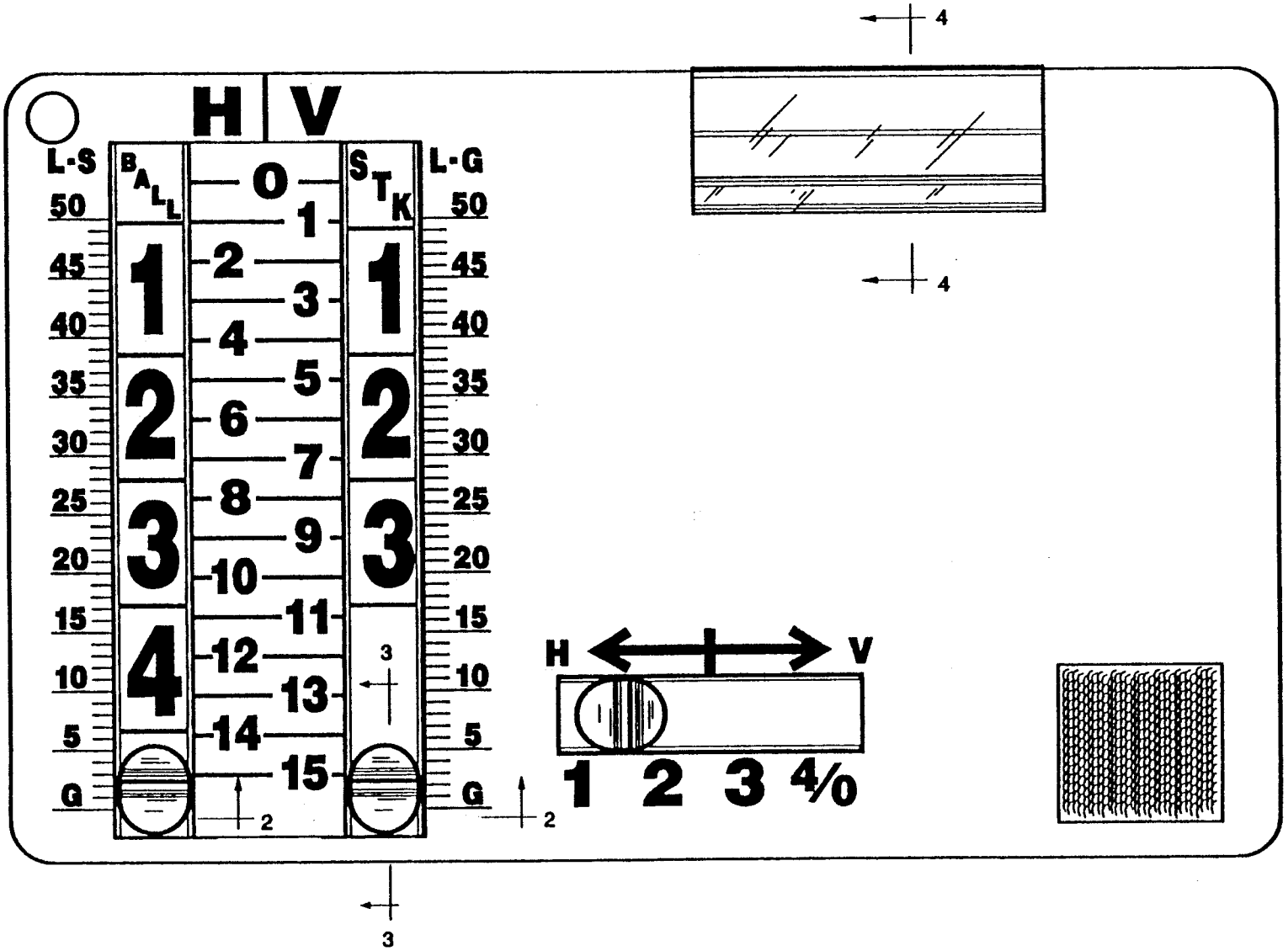
FIG. 1 is a top plan view of the GAME DATA BOARD of the present invention.

Referring now to FIG. 1, there is illustrated therein a GAME DATA BOARD 10 which includes a planar substrate or board 12 that preferably is made of plastic. The planar substrate has dimensions of approximately 5 inches, by 8 inches, by 3/16 inch.

Figure 3:
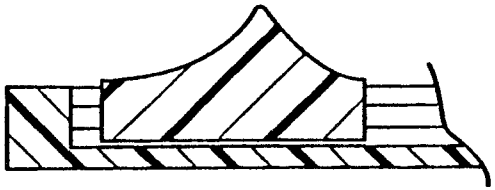
FIG. 3 is a sectional view taken along line 2—2 of FIG. 1 through a slide forming part of the GAME DATA BOARD.

The planar substrate 12 has an upper surface 14, a lower surface 16 and a peripheral side edge 18 (FIG. 3).

In the upper left hand corner 20 of the substrate 12 is a hole 22 through which a, string, chain or cord (not shown) can be inserted for hanging the scoring/coaching aid 10 from the belt of the user. Preferably, a ¼ inch grommet (not shown) is secured in the hole 22.

At an upper right hand portion 24 of the upper surface 14 of the substrate 12 is a double purpose clip 26. As shown in FIG. 1, below the clip 26 is an a real surface area 28 large enough to receive a 3 inch by 5 inch card thereon. The clip 26 bears against the upper surface 14 of the plastic substrate and the areal surface area 28 receives the 3 inch by 5 inch card (not shown) thereon clipped to the substrate 12.

Figure 4:
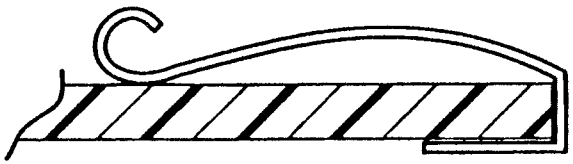
FIG. 4 is a sectional view through a pencil or pen holder mounted on the substrate of the GAME DATA BOARD.
Figure 1:
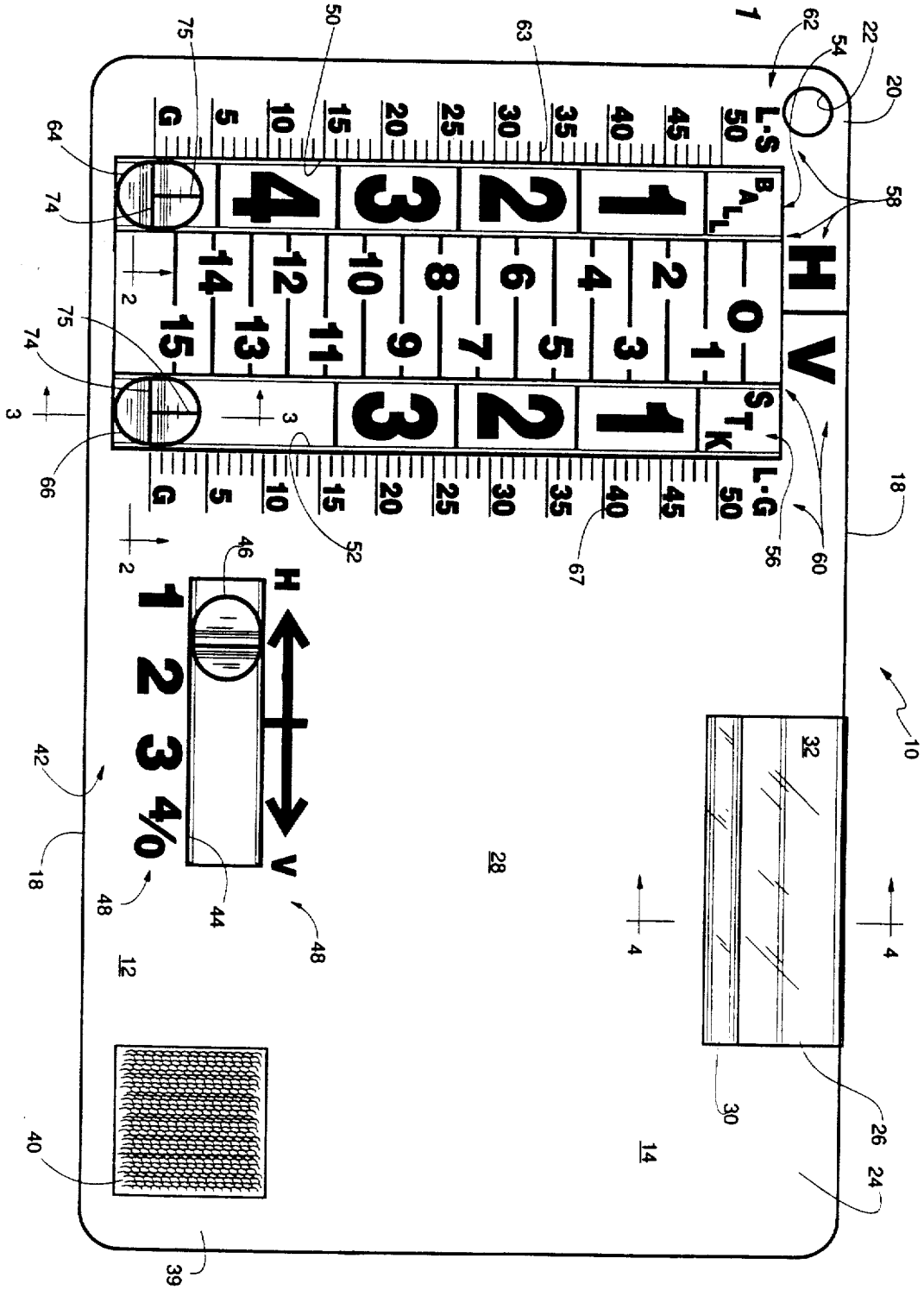
Figure 2:
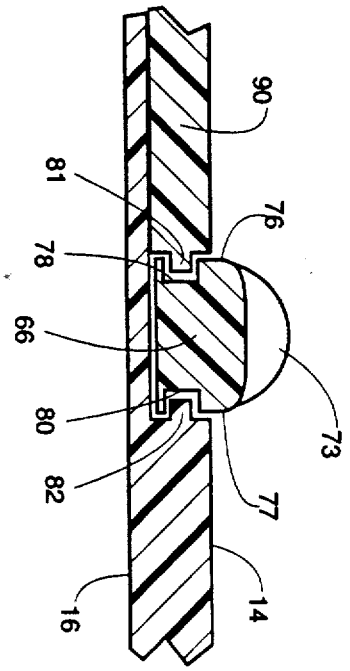
Figure 3:
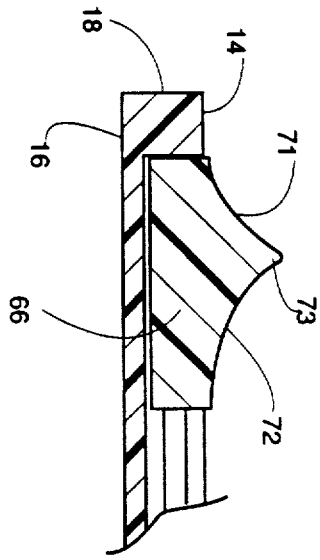
Figure 4:
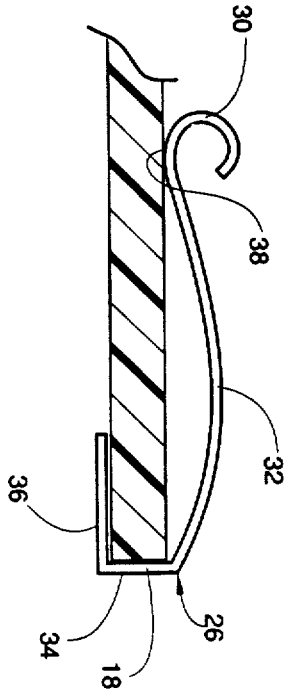

As shown in FIG. 4, a curled end 30 of the clip 26 can receive a pencil or pen. The clip 26 further includes a bowed spring portion 32 which extends to a downwardly extending end flange 34 which extends along the side edge 18 of the substrate 12 to an inwardly extending bottom flange 36. The spring force between the bottom flange 36 and the lower surface 16 of the substrate 12 and a curved surface 38 at the curved end 30 of the bowed spring portion 32 holds the clip 26 to the substrate 12.

At a lower right hand corner area 39 is a piece 40 of Velcro TM for releasable fixing an object to the scoring-/coaching aid 10, such as a stopwatch (not shown). The Velcro TM piece 40 also can be used for securing other items to the GAME DATA BOARD 10 and, of course, other fastening means besides Velcro TM can be used.

In the lower central portion 42 of the upper surface 14 of the substrate 12 is a slot 44 having a marking slide 46 therein. Indicia 48 in the form of the letter H at the upper left hand corner and the letter V at the upper right hand corner of the slot 44 respectively designate respectively, Home or Visitor, the marking slide 46 is moved to indicate who has possession of a ball—the home team or the visiting team. The slide 46 also can be used for showing who has the next possession in basketball.

Underneath the horizontally extending slot 44 and forming most of the indicia 48 are numbers 1, 2, 3, 4/0, such that the slide 46 can be used for indicating outs in baseball or for indicating the downs in a football game.

As stated above the area 28 above the horizontal slot 44 and the piece 40 of Velcro TM and beneath the clip 26 is of sufficient size to permit placing of a 3 inch by 5 inch card on the substrate 12 and held to the substrate by the clip 26.

On the left side of the substrate 12 are two slots 50 and 52 having indicia 54, 56 therein and indicia 58, 60 adjacent to each slot 50, 52 on either side thereof.

The indicia 58 includes the letter H relating to the slot 50 and separated by a vertical line from a V forming part of the indicia relating to the slot 50. H, of course, stands for Home Team and V, of course, stands for Visiting Team.

Starting from the left hand side, the indicia 58 includes a column of indicia 62 with the heading L-S standing for "line of scrimmage". Then beneath that are numbers extending from the number 50 to G (for Goal) and line marks 63 so that a marking slide 64 in the slot 50 can be positioned adjacent the line of scrimmage where a football of the Home Team or the Visiting Team is located.

Then inside the slots are the indicia 54 starting with BALL at the top followed by 1, 2, 3, 4 whereby the slide 64 can be positioned to indicate the balls for a baseball player at bat. Then in the middle there is indicia forming part of both indicia 58 and 60 which can be used with slide 64 in either slot 50 or a slide 66 in the slot 52. The indicia starts from the top and goes to the bottom 0, 1, 2 . . . to 15. Again either slide 64 or 66 can be placed adjacent the middle indicia for any one of these numbers to indicate the game scores or team fouls for Home and Visiting Teams.

Also, the indicia in the middle can be used for counting laps of a swimmer, or for a runner.

Then in the slot 52 are the indicia 56 separated by lines starting with STK for strike and 1, 2, 3. Here the slide 66 can be used to indicate strikes of a baseball player at bat.

Then on the right hand side of the GAME DATA BOARD 10 is more of the indicia 60 starting with L-G and then the numbers 50 downwardly to G for goal and line marks 67.

Figure 2:
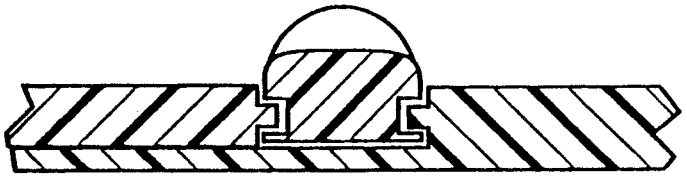
FIG. 2 is a sectional view taken along line 2—2 of FIG. 1 through a slide forming part of the GAME DATA BOARD.

As shown in FIGS. 2 and 3, each slide 66, 64 or 46 has an upper surface 70 with two concave portions 71 and 72 and a middle hump 73 to facilitate engagement of the slide 66, 64 or 46 by thumb or finger for moving the slide 66, 64 or 46 in the slot 52, 50 or 44, as best shown in FIG. 3. Also slides 66, 64 and 44 each have a horizontal line 74 on the hump 73 and slides 66 and 64 have vertical line 75 in the concave portion 72 normal to the line 75 (FIG. 1).

Then, as best shown in FIG. 2, each side 76, 77 of each slide 66, 64 or 46 has a slot 78, 80 therein which mates with a longitudinally extending rail 81 or 82 on each side of the slot 52, 50 or 44.

In FIG. 2 it will be noted that a rectangular portion 90 between the slides 64, 66 having the indicia numbers 0–15 may be a separate piece which, after each slide 64 and 66 has been positioned in the space for slot 50 or 52, can be positioned in the middle thereby defining an inner edge of each slot 50, 52, and can be secured to the remainder of the substrate 12 by a suitable adhesive or by solvent bonding.

It will also be understood that suitable means are provided for mounting the slide 46 in the slot 44 or the slide 46 can be constructed so as to be snap fittingly received in the slot 44.

From an inspection of the GAME DATA BOARD shown in FIG. 1, it will be apparent that it is designed for use in physical education, recreational and intermural sports programs where the teacher/leader/coach desires to keep track of certain game information from involvement as a leader, score keeper, referee or umpire for that game activity. The three slides 46, 64 and 66, as well as the array of embossed and engraved numbers, letters and figures allow the operator of the GAME DATA BOARD to record the following game data:

| Basketball | Baseball/Softball | Football |
|---|---|---|
| Team fouls<br>Possession arrow | Balls<br>Strikes<br>Outs | Down<br>Line to gain<br>Line of Scrimmage |
| **Track/Swimming** | **Volleyball** | **Wrestling** |
| The Velcro TM attachment means are provided for stopwatch for counting time<br>Middle indicia 0–15 serves as lap counter | Points scored by each team<br>Serving team | Match points<br>Each opponent riding time with the stopwatch attached to the Velcro TM |

Preferably, the GAME DATA BOARD 10 is factory molded of plastic. Embossed and engraved sets of numbers, letters and figures are molded or formed or painted on the upper surface of the plastic substrate adjacent and in conjunction with the location of the three slides 46, 64, and 66 for allowing the monitoring of game data, as described above.

The tract rails 81, 82 in the slots 44, 50 and 52 can be cut into the face of the plastic substrate 12 or molded therein. Then the slides 46, 64, and 66 forming indicators/cursors are placed into each slot 44, 50, 52 and loosely held therein. The line 74 at the top of each hump 73 of each slide 46, 64, 66 is used to align with an embossed or engraved number along the side of the slot 44, 50 or 52 and the vertical line 75 of slide 50 or 52 can point to a number for the balls or strikes on a batter.

Preferably, the numbers 0–15 between the slots 50 and 52 are black engraved numbers. Each of the cursors or slides 46, 64, 66 is white with a black indicating line 74 at the hump. The slides 46, 64 and 66 also have the vertical indicating line extending vertically upwardly 90° to the horizontal line 74 in the concave surface 72.

The indicia 56, STK and 1, 2, 3, in the slot 50 can be red, and the indicia 54, BALL 1, 2, 3, 4, in the slot 52 can be green. The other numbers for the line of scrimmage or line to gain can be black or any other desired color. The same applies to the letters H and V for home and visitor and the numbers 1, 2, 3, 4/0 beneath the slot 44. The upper surface of the plastic substrate is preferably white.

The scroll-shaped clip 26 is designed to permit a 3 inch by 5 inch card to be held in place on the face of the substrate 12. In addition, the scroll-shape allows a small pencil to be kept in place.

The Velcro TM fastener 40 at the lower right hand corner area 39 is secured to the substrate and allows the matching Velcro TM partner to be placed on a stopwatch with the purpose of securing the watch to the board.

Integral to using the GAME DATA BOARD are the slides 44, 64 and 66 and the numbering system for keeping ongoing game data. Each of the three slides or cursors 44, 64, 66 is white and has the black indicator line 74 on it. When the indicator line 74 is alligned with the embossed or engraved numbers or figure the stated data may be kept.

Slide 64 runs vertically nearer the left edge of the GAME DATA BOARD 10 and can be used in the following manner: when aligned with the embossed numbers to the left of slide 64 the cursor slide 64 will indicate current "line of scrimmage" in the Football Mode; moving the cursor slide 64 from bottom to top position would also allow a home team score from 1 to 50 points to be kept.

When slide 64 is used with the green engraved numbers in the center of the cursor tack "Balls" is indicated in the Baseball/Softball mode. When the slide 64 is used with the numbers to it's right the following game data is indicated, home team fouls in Basketball, home team score in Volleyball, Wrestling, points scored by home team in other low organized games and activities, lap counter for runner or swimmer.

Slide 66 runs vertically and is positioned 2⅜" from the left edge. Slide 66 is used in the following manner: The numbers embossed to it's right are used to identify the "line to gain" in the Football mode; the red numbers engraved in the slot 56 are used to indicate "strikes" in the Baseball/Softball mode. The numbers to the left are used to indicate visitor team fouls in Basketball, visitor team score in Volleyball, Wrestling, points scored by visitor team in other low organized games and activities, lap counter for runner or swimmer.

The slide 46 runs horizontally and parallel to the bottom edge of GAME DATA BOARD 10. The embossed indicia above the slide 46 is a home/visitor possession arrow in the Basketball mode and may be used to identify the serving team in Volleyball; the numbers below slide 46 are used to indicate "downs" in the Football mode and "outs" in the Baseball/ Softball mode.

While hand held clipboards of varying sizes and materials are common use of a slide, no device known to applicant and currently available provides the numbering arrangement and configuration that when used with a slide(s) allows the user to indicate a multitude of game data as in the GAME DATA BOARD 10 of the present invention.

I claim:

1. A GAME DATA BOARD comprising: a planar substrate having an upper surface and lower surface; a first marking slide; first passage means in said upper surface of said planar substrate for receiving said first marking slide and for permitting movement of said first marking slide therein; first indicia on said upper surface of said planar substrate adjacent said first passage means and arranged relative to said first marking slide so as to permit said first marking slide to be moved in said first passage means to various positions adjacent said first indicia for indicating particular scoring for at least one sport; a second marking slide; second passage means in said upper surface of said planar substrate for receiving said second marking slide and for permitting movement of said second marking slide therein; second indicia on said upper surface of said planar substrate adjacent said second passage means and arranged relative to said second marking slide so as to permit said second marking slide to be moved in said second passage means to various positions adjacent said second indicia for indicating particular scoring for at least one other sport or game; said first passage means including an upwardly facing bottom surface; and third indicia on the bottom surface of said first passage means for indicating scores or statistics for the at least one other sport or game.

2. The GAME DATA BOARD of claim 1 wherein said first and second passage means are linear and parallel spaced from one another.

3. The GAME DATA BOARD of claim 1 wherein said third indicia includes letter indicating "strike" and the numbers 1, 2, 3.

4. The GAME DATA BOARD of claim 1 wherein said second passage means includes an upwardly facing bottom surface and fourth indicia are provided on the bottom surface of said second passage means.

5. The GAME DATA BOARD of claim 4 wherein said fourth indicia includes letter indicating the word "ball" and the numbers 1, 2, 3, 4.

6. The GAME DATA BOARD of claim 1 wherein said first indicia includes letters indicating line to gain, line markings, letter indicating goal at one end of the line markings, the number 50 at the other end of the line Markings and intermediate numbers therebetween.

7. The GAME DATA BOARD of claim 1 wherein said second indicia includes letter indicating line of scrimmage, line markings, letter indicating goal at one end of the line markings, the number 50 at the other end of the line markings and intermediate numbers therebetween.

8. The GAME DATA BOARD of claim 1 wherein said first and second indicia share and include line markings and numbers disposed between said first and second passage means.

9. The GAME DATA BOARD of claim 8 wherein said numbers extend from 0–3.

10. The GAME DATA BOARD of claim 8 wherein said numbers extend from 0–4.

11. The GAME DATA BOARD of claim 8 wherein said numbers extend from 0–9.

12. The GAME DATA BOARD of claim 8 wherein said numbers extend from 0–15.

13. The GAME DATA BOARD of claim 1 wherein said first and second indicia, respectively, include indicia indicating a home team or a visiting team.

14. The GAME DATA BOARD of claim 1 further including: a third marking slide; third passage means in said upper surface of said planar substrate for receiving said third marking slide and permitting movement of said third marking slide therein; selected indicia on said upper surface of said planar substrate adjacent said third passage means and arranged relative to said third marking slide so as to permit said third marking slide to be moved in said third passage means to various positions adjacent said selected indicia for indicating particular scoring.

15. The GAME DATA BOARD of claim 4 wherein said selected indicia comprises: the numbers 1, 2, 3, 4/0 on one side of said third passage means and a double headed arrow and indicia at each arrow head indicating a home team or visiting team on the other side of said third passage means.

16. The GAME DATA BOARD of claim 1 wherein sufficient areal space is provided on said upper surface of said substrate for placing scoring paper on said upper surface of said planar substrate.

17. The GAME DATA BOARD of claim 16 further comprising clips means for clipping said scoring paper to said substrate.

18. The GAME DATA BOARD of claim 17 wherein said clip means includes means for holding a marking implement.

19. The GAME DATA BOARD of claim 1 further including attachment means on said planar for attaching an item useful in monitoring a sport to said upper surface.

20. The GAME DATA BOARD of claim 19 wherein said attachment is an array of loops sold under the trademark Velcro.

21. The GAME DATA BOARD of claim 1 wherein said substrate has a hole through a corner thereof to permit said game data board to be fastened by a cord, chain or string to a belt of a user thereof.

22. The GAME DATA BOARD of claim 1 wherein each passage means is defined between passage side walls which have means for engaging and retaining said marking slide in said passage means.

23. The GAME DATA BOARD of claim 1 wherein each marking slide has a raised portion intermediate the ends thereof and concave surfaces on either side of the raised portion to facilitate easy engagement of the marking slide with a thumb or finger for moving said marking slide in said passage means and a marking line is provided on said raised portion.

24. The GAME DATA BOARD of claim 23 wherein each marking slide has a second marking line normal to said marking line on said raised portion.

* * * * *

UNITED STATES PATENT AND TRADEMARK OFFICE

CERTIFICATE OF CORRECTION

PATENT NO. : 5,062,381

DATED : November 5, 1991

INVENTOR(S) : Kenneth J. Henricks

It is certified that error appears in the above-indentified patent and that said Letters Patent is hereby corrected as shown below:

On the title page, item (19) and (76) "Inventors", Kenneth J. Herdricks, should read --Kenneth J. Henricks--.

The title page, should be deleted to appear as per attached title page.

The sheets of drawings, consisting of figures 1-4, should be deleted to appear as per attached sheets.

Abstract, line 1, "subsrate" should read--substrate--.

Signed and Sealed this

Twenty-sixth Day of April, 1994

*Attest:*

Bruce Lehman

BRUCE LEHMAN

*Attesting Officer*

*Commissioner of Patents and Trademarks*

United States Patent [19]

Hendricks

[11] Patent Number: 5,062,381

[45] Date of Patent: Nov. 5, 1991

[54] GAME DATA BOARD

[76] Inventor: Kenneth J. Hendricks, 718 Coral Ave., Bartlett, Ill.

[21] Appl. No.: 575,375

[22] Filed: Aug. 29, 1990

[51] Int. Cl.[5] ..... A63B 71/06

[52] U.S. Cl. ..... 116/225; 116/222; 116/321; 116/323; 24/11 PP

[58] Field of Search ..... 116/222-225, 116/321, 323, 324; 24/11 PP, 67.3, 67.11; 273/DIG. 26; 235/1 B, 123

[56] References Cited

U.S. PATENT DOCUMENTS

| | | | |
|---|---|---|---|
| 546,959 | 9/1895 | Larzetere | 116/225 |
| 2,134,039 | 10/1938 | Gibbs | 116/223 |
| 2,731,941 | 1/1956 | Anderson | 116/324 |
| 3,204,356 | 9/1965 | Close et al. | 24/67.3 |
| 3,902,450 | 9/1975 | Bosshold | 116/323 |
| 4,157,152 | 6/1979 | Blastic | 224/247 |
| 4,610,054 | 9/1986 | Malian | 24/67 R |
| 4,738,449 | 4/1988 | Droz | 273/29 R |

*Primary Examiner*—William A. Cuchlinski, Jr.
*Assistant Examiner*—W. Morris Worth
*Attorney, Agent, or Firm*—Thomas R. Vigil

[57] ABSTRACT

A game data board formed as a planar subsrate having an upper surface and lower surface; a first marking slide; first passage means in the upper surface of the planar substrate for receiving the first marking slide and for permitting movement of the first marking slide therein; first indicia on the upper surface of the planar substrate adjacent the first passage means and arranged relative to the first marking slide so as to permit the first marking slide to be moved in the first passage means to various positions adjacent the first indicia for indicating particular scoring for at least one sport; a second marking slide; second passage means in the upper portion of the planar substrate for receiving the second marking slide and for permitting movement of the second marking slide therein; second indicia on the upper surface of the planar substrate adjacent the second passage means and arranged relative to the second marking slide so as to permit the second marking slide to be moved in the second passage means to various positions adjacent the second indicia for indicating particular scoring for at least one other sport or game; the first passage means including an upwardly facing bottom surface; and third indicia on the bottom surface of the first passage means for indicating scores or statistics for the at least one other sport or game.

24 Claims, 2 Drawing Sheets

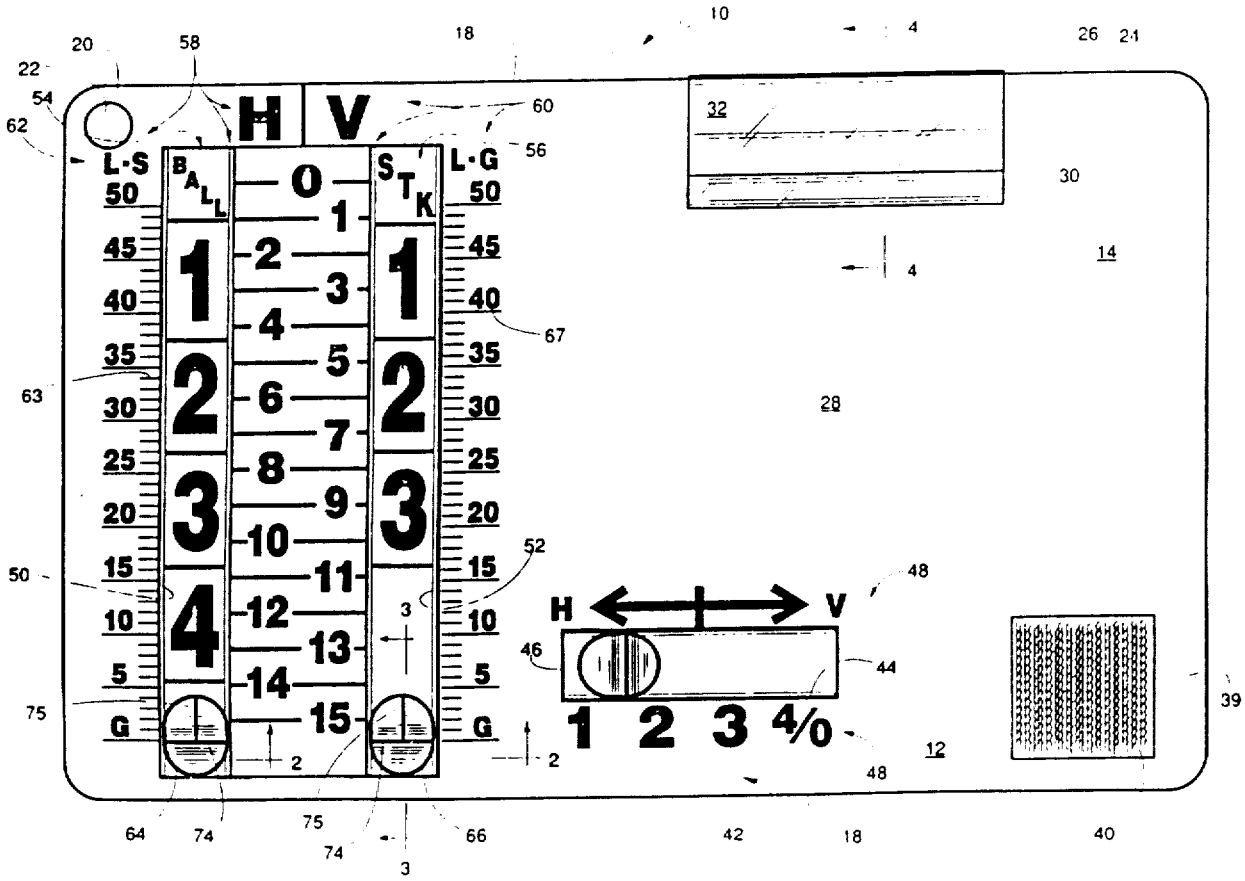

UNITED STATES PATENT AND TRADEMARK OFFICE

CERTIFICATE OF CORRECTION

PATENT NO. : 5,062,381

DATED : November 5, 1991

INVENTOR(S) : Kenneth J. Henricks

It is certified that error appears in the above-indentified patent and that said Letters Patent is hereby corrected as shown below:

Column 2, line 2, "including and upwardly" should be including an upwardly—.

Column 2, line 3, "surface o" should be —surface of—.

Column 2, line 24, "a real" should be —areal—.

Column 5, line 67, "letter" should be —letters—.

Column 6, line 6, "letter" should be —letters—.

Column 6, line 10, "letter" should be —letters—.

Column 6, line 14, "letter" should be —letters—.

Column 6, line 15, "letter" should be —letters—.

Column 6, line 46, "claim 4" should be —claim 14—.

Column 6, line 57, "clips" should be —clip—.

Column 6, line 63, "planar for" should be —planar surface for—.

Column 6, line 67, "attachment is" should be —attachment means is —.